US005590478A

United States Patent [19]

Furness

[11] Patent Number: 5,590,478

[45] Date of Patent: Jan. 7, 1997

[54] MASONRY HEATING SYSTEM

[75] Inventor: Frederick D. Furness, 603 Old Bethlehem Rd., Quakertown, Pa. 18951

[73] Assignees: Frederick D. Furness, Quakertown; James L. Uhrich, Allentown, both of Pa.

[21] Appl. No.: 603,715

[22] Filed: Feb. 20, 1996

[51] Int. Cl.[6] ..... F26B 7/00

[52] U.S. Cl. ..... 34/437; 34/487; 34/104

[58] Field of Search ..... 34/582, 359, 437, 34/439, 440, 487, 164, 235; 126/110 B, 85 A, 85 B; 237/50; 454/270, 271, 272, 357

[56] References Cited

U.S. PATENT DOCUMENTS

| | | | |
|---|---|---|---|
| 1,749,448 | 3/1930 | Sculthorpe | 34/437 |
| 2,410,353 | 10/1946 | McCollum | 126/110 B |
| 2,592,578 | 4/1952 | Kogl | 25/118 |
| 3,659,077 | 4/1972 | Olson | 219/213 |
| 3,729,614 | 4/1973 | Martinet | 219/345 |
| 3,796,551 | 3/1974 | Pope | 34/359 X |
| 3,805,405 | 4/1974 | Ambos | 34/104 |
| 5,155,924 | 10/1992 | Smith | 34/443 |
| 5,419,059 | 5/1995 | Guasch | 34/443 |

*Primary Examiner*—Henry A. Bennett
*Assistant Examiner*—Steve Gravini
*Attorney, Agent, or Firm*—Gregory J. Gore

[57] ABSTRACT

An inside-out heating method provides efficient and economical heating of wet cement during the curing phase in building structures. Hollow building blocks and their cement joints may be heated by applying forced hot air injected at the base of the wall. The hot air rises up through the wall and out of the open end of the top course of block by the chimney effect of the hot air rising through the ducting created by the aligned vertical passageways in the hollow blocks. The hot air is distributed through the wall by a manifold and injection tubes which provide air ducting from a heat source, such as a forced air propane heater. Temporary holes are broken through a low level course of block to receive the hot air injection tubes. After the cement has fully dried, the injection tubes are removed and the temporary holes are filled in with cement.

10 Claims, 5 Drawing Sheets

MASONRY HEATING SYSTEM

FIELD OF THE INVENTION

This invention relates to heating systems for accelerating drying time of masonry building cement or to provide the minimum required temperature at which masonry cement may be worked. More specifically, the invention relates to heating the cement as concrete blocks of a masonry wall are being laid in cold weather.

BACKGROUND OF THE INVENTION AND DESCRIPTION OF PRIOR ART

One of the most common construction materials is preformed, hollow concrete or cinder block which is laid with masonry cement between the joints to build vertical walls. A particular problem in cold weather locations is maintaining the minimum temperature at which the cement mixture, which is a water-based compound, can be worked and dried. If the temperature is less than 32-degrees, an external heat source must be applied to raise the temperature of the cement so that the cement will not freeze and will set and dry in a short enough time to make the construction economically feasible. Prior art techniques of increasing the masonry temperature include heating the blocks and mixing the cement with hot water, and/or enclosing the entire work area with a temporary enclosure heated by a space heater. These measures are extremely expensive. Nonetheless, space heating is employed because of the even greater cost of delaying construction due to cold weather.

The most pertinent prior art patent of which the applicant is aware includes U.S. Pat. No. 3,729,614 issued on Apr. 24, 1973, entitled "Device for Accelerating the Setting of Concrete". This reference discloses means for heating and supplying water to a heating blanket which distributes the water in liquid or vapor form over the exterior surface of the concrete.

U.S. Pat. No. 2,592,578 issued on Apr. 15, 1952, entitled "Concrete Step Form", discloses a form for casting concrete steps which includes heating devices to apply heat to the outside of the concrete casting by locating heaters inside the form. U.S. Pat. No. 3,659,077 issued on Apr. 25, 1972, entitled "Apparatus for the Curing of Concrete", discloses the use of a layer of heat-conducting material carried by a frame in a position to overlie the upper surface of mixed concrete. The heat may be applied to a form or a flexible blanket that is placed over the exposed upper surface of the curing concrete mix. U.S. Pat. No. 5,419,059 entitled "Apparatus for Directing Pressurized Air Into A Wall or Ceiling for Drying Purposes Through An Electrical Box" issued on May 30, 1995 discloses the use of applying the inside of a wall damaged by water. However, none of the above-cited references teach or suggest the application of heat through passageways internal to the formed structure.

SUMMARY OF THE INVENTION

The present invention has been devised in order to provide a solution to the cold weather problem in the building construction arts noted above. The applicant's use of novel inside-out heating method provides efficient and economical heating of the cement mixture during the building of a hollow block wall which does not obstruct the work area. The applicant's invention adopts the concept of heating the hollow block internally to achieve the desired minimum working and setting temperatures of the cement, rather than applying the heat externally as in the prior art. To apply the heat, forced hot air is injected at the base of the wall. The hot air rises up through the wall and out of the open end of the top course of block by the chimney effect of the hot air rising through the ducting created by the vertical passageways in the hollow blocks.

The hot air is injected through temporary holes broken through a low course of block along the bottom of the wall to be constructed after that course has been laid. Heat-injection tubes are fitted into these holes which supply the hot air. A large manifold which is substantially horizontal and runs parallel to the wall feeds each of the heat-injection tubes. A forced air heat source, such as a propane heater, is connected to the manifold in a central location. After the last course of block is laid and the cement fully dried, the injection tubes are removed and the temporary holes are filled in with cement.

More specifically, the applicant has invented a heating system for a cemented hollow block wall, comprising: a heat source; a manifold in fluid communication with the heat source; a plurality of injector tubes, each tube having first and second ends, the first end of each tube being in fluid communication with the manifold; a plurality of hollow blocks laid together with cemented joints, block upon block, to form a building wall having at least one substantially vertical side surface; and a plurality of apertures in the side surface of said hollow block wall, the apertures receiving at least one of the second ends of the injector tubes whereby an internal cavity within the wall is in fluid communication with the heat source. The manifold is an elongate duct located parallel to and along the base of the side of the wall. The heat source, which is fuel-burning, provides hot air that is forced into the manifold. The injector tubes are flexible and may comprise flexible aluminum tubing. An adapter flange is located between at least one of the first ends of the injector tubes and the manifold.

The applicant's invention further includes a method of heating a hollow block wall to accelerate the curing rate of drying cement in the joints of said wall, comprising the following steps: laying a plurality of hollow blocks together with cemented joints, block upon block, to form a building wall having at least one substantially vertical side surface; forming a plurality of temporary apertures in the side surface along the base of the wall; providing a heat source; injecting hot air from the heat source into the apertures in the side surface of the hollow block wall, whereby the hot air travels upward through an internal cavity in the wall, thus applying heat to blocks and joint cement located above the level at which the hot air is applied; and, finally, filling the temporary apertures with cement once the cement has dried.

It is the primary object of the invention to provide an efficient means for temporarily heating masonry cement and block as it is being laid in cold weather without obstructing the work area. It is a further object of the present invention to create a heating system for the construction of a cemented block wall which is economical to use and effective in ambient temperatures below 30° F. Other objects and advantages of the present invention will be apparent to those of ordinary skill in the art from the following drawings and description of the preferred embodiment.

DESCRIPTION OF THE PREFERRED EMBODIMENT

Figure 1:
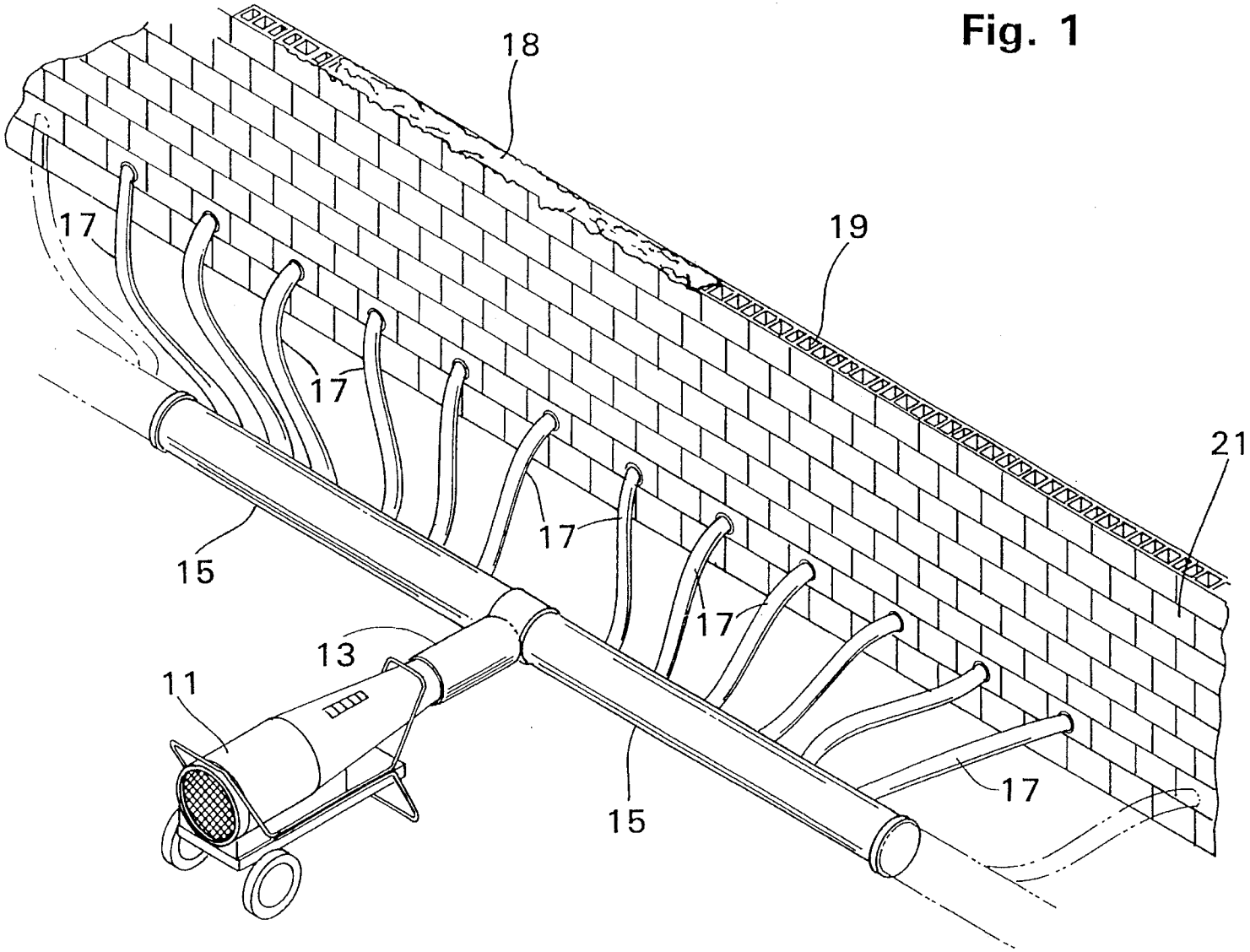
FIG. 1 is a top right front isometric view of the present invention.

Referring now to FIG. 1, the present invention includes a heat source 11, preferably a forced air fuel-burning heater, such as a propane heater, which is in fluid communication with manifold 15 through T-duct connector 13. From the rear side of the manifold, a plurality of injector tubes 17 connect the interior of the manifold with apertures formed in the side of the masonry blocks of wall 21. The particular dimensions of the air ducting is not critical but, for example, a 12-inch diameter cylindrical manifold may be used in conjunction with 3-inch diameter injection tubes. As depicted in this figure, the cement blocks are of the type commonly used which include hollow, vertical passageways 19. As shown in this figure, fresh cement 18 is placed along the top of the wall as the next course of block is laid.

Figure 2:
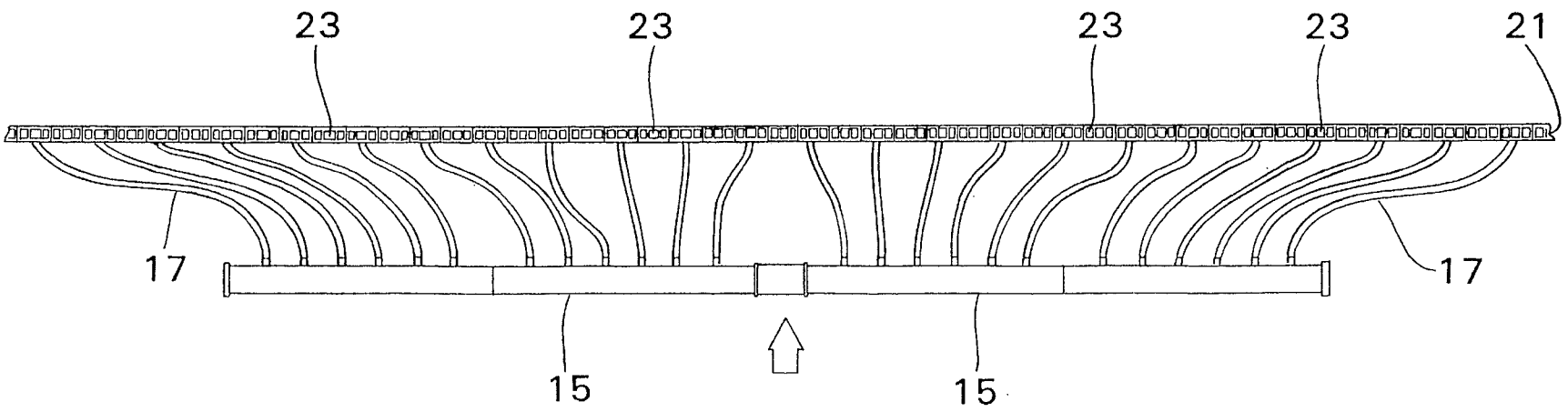
FIG. 2 is a top view of the present invention.

Referring now to FIG. 2, the top view of the present invention is shown with manifold 15 feeding hot air represented by the arrow from the heat source into the concrete block wall 21 through injector tubes 17. It will be readily understood by those of skill in the art that hot air from the injector tubes will normally flow into the cement block wall and exit the plurality of vertical cavities in the top course of blocks which are shown in this figure as cavities 23. The blocks shown in this drawing have three vertical hollow cavities each, but it should be understood that other configurations of hollow block may be used with the present invention so long as the cavities are vertical.

Figure 3:
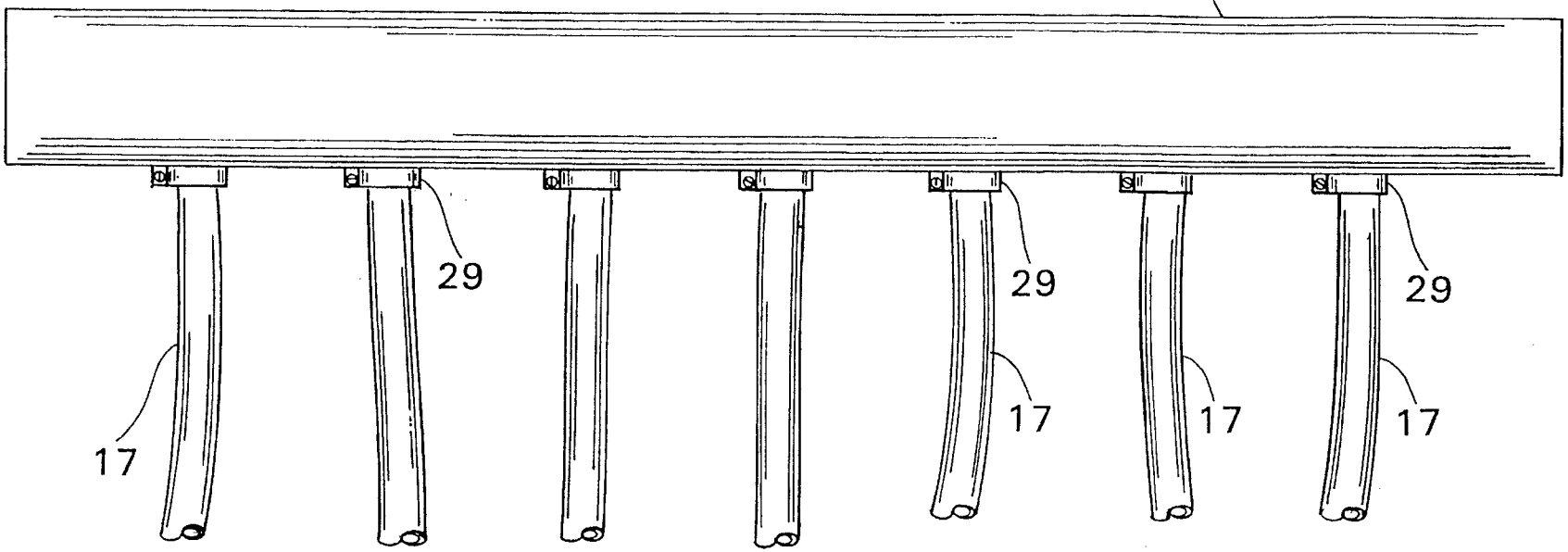
FIG. 3 is a top view of the manifold and injector tubes.
Figure 4:
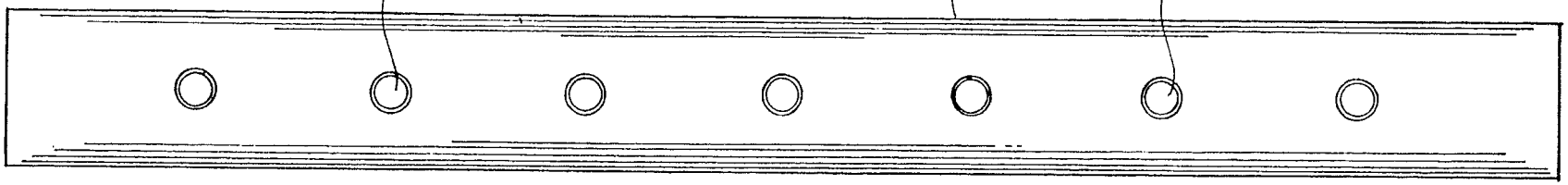
FIG. 4 is a rear view of the manifold and injector tubes.

Referring now to FIGS. 3 and 4, greater detail of the manifold and injector tubes is shown. FIG. 4 shows the cylindrical manifold 15 in which ports 27 have been cut. FIG. 3 shows the injector tubes 17 fitted to the manifold ports with the use of intermediate adapter collars 29. These collars are affixed to the manifold and clamped to the injector tubes and may include a reducing or enlarging flange so that different diameter injector tubes may be fitted. The injector tubes of the preferred embodiment are aluminum flexible ducting, but this material may be substituted for other materials, such as rubber hoses, so long as the requirement of strength, flexibility and high melting point are provided. The injector tubes need to be crush-resistant enough to withstand the impact of falling cement from workers laying blocks along the top of the wall above.

Figure 5:
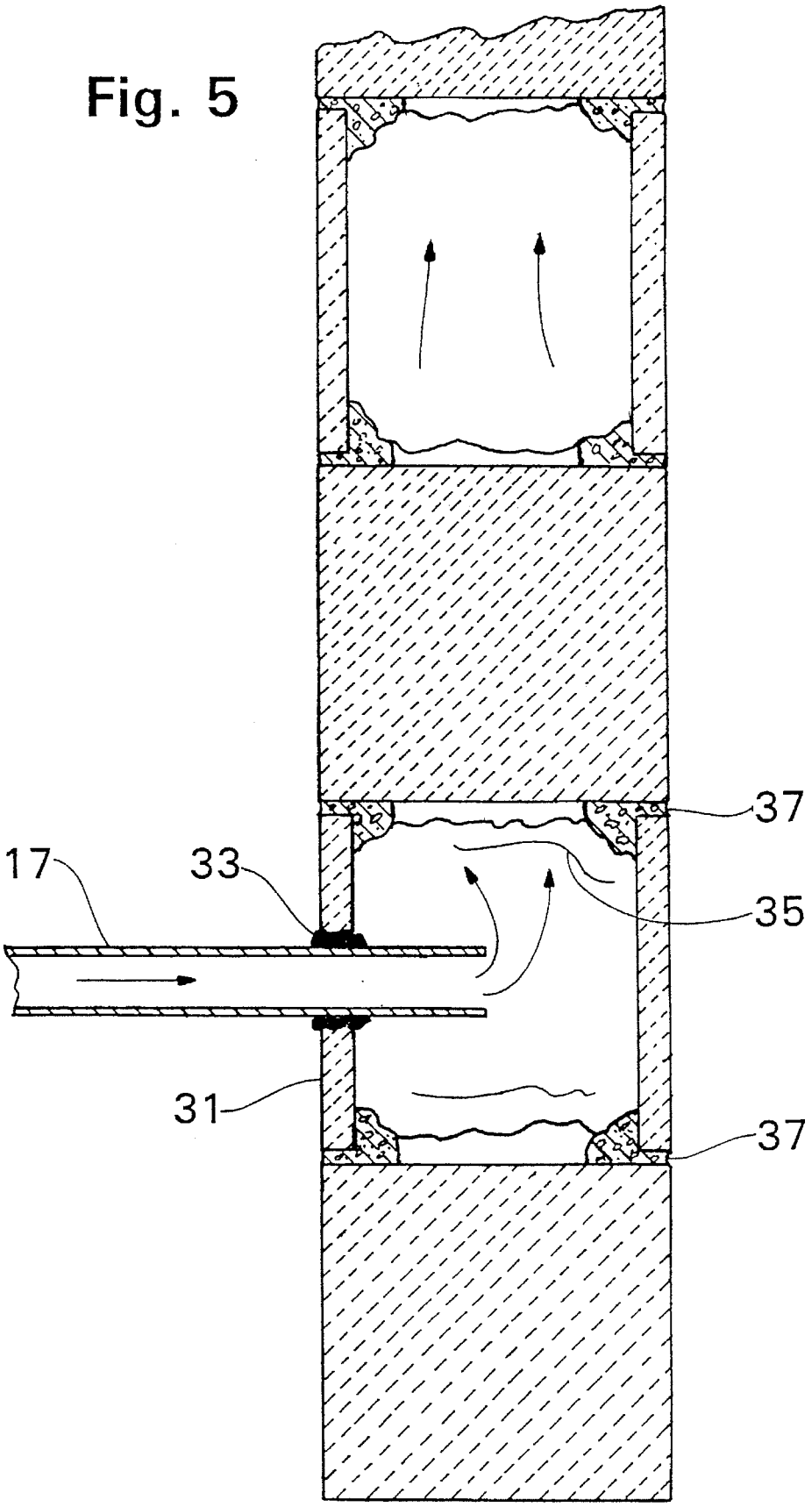
FIG. 5 is a side sectional view of an injector tube and the building wall.

Referring now to FIG. 5, one of the injector tubes of the present invention 17 is shown fitted into block 31 of the building wall. Hot air depicted by the arrows is shown flowing through the injector tube 17 into the vertical cavities within the hollow blocks. The injector tubes are fitted through apertures in the side wall of the hollow block. These apertures are temporarily formed by knocking through the side wall of the block with a sharp tool. Thereafter, the injector tube is fitted into the block and a packing material 33, such as loose fiberglass batting is fitted around the injector tube to minimize heat loss and to contain the flow of air within the block. After drying is completed, the tubes are withdrawn and the apertures are filled in with cement.

The particular effectiveness of the present heating system to accelerate the setting and drying time of the cement may be better understood by referring again to FIG. 5. It should be noted by observing the surface area of the cement 35 which is presented into the interior of the block, that this surface area is much greater than say the surface area 37 which is presented to the exterior of the block as a narrow pointed joint. Because of the greater available surface area of the cement available to conduct the heat, the cement drying time using internal forced hot air is greatly accelerated. It is this novel recognition of greater available surface area that forms the basis for the present invention. It will also be appreciated from this figure of drawing that as the hot air rises through the block through a maze of vertical passageways between the mating blocks, the cavities in the block not only minimize heat loss against the ambient air, but also provide a vacuum effect from the upward flow of air which assists in drawing hot air from the injector tubes. In this way, heat rises up through the inside of the wall which ultimately escapes from the cavity apertures along the final course of blocks along the top of the wall. This is also the area where fresh cement is being laid and thus it is immediately exposed to the rising hot air.

In tests of the present invention, this system has demonstrated that cement block walls can be laid in ambient temperatures as low as 26° F. with the wall being heated successfully to a height of over 20 feet. A 350,000 BTU propane heater was used which fed a 40-foot long manifold. The manifold used was a 12-inch diameter uninsulated steel duct capped at the ends. With the heater left on overnight, complete drying of the cement is observed the next day. This test was carried out using the present invention in conjunction with the prior art techniques of cold weather masonry which include pre-heating the cement and the blocks.

Figure 6:
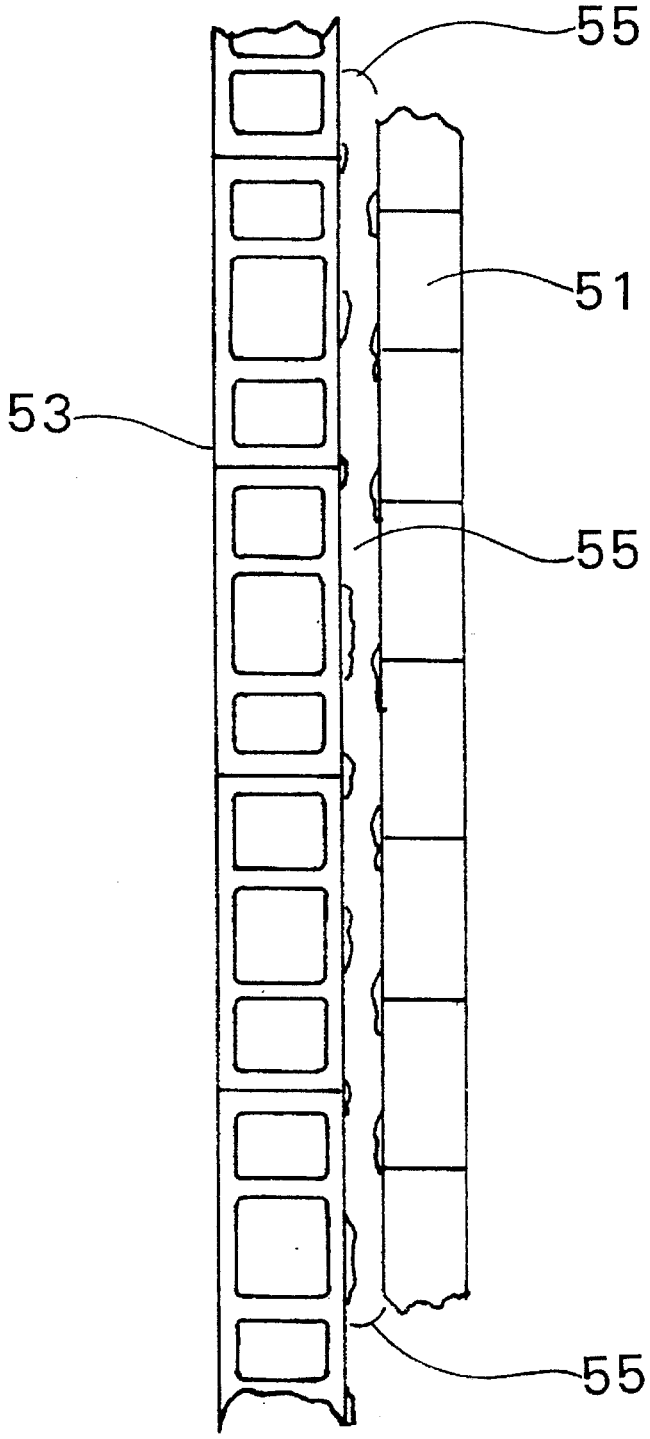
FIG. 6 is a top sectional view of an alternate embodiment of the present invention wherein the vertical cavity is a space between adjacent vertical walls.

The present forced air heating system may also be applied to any building structure which employs cement that requires drying; for example, hollow core cast structures which may form either walls or floor structures. It may also be used in areas of construction where a hollow gap is provided between adjacent masonry structures, such as a veneer brick wall constructed next to, but not in direct contact with an adjacent building wall. The gap between the walls may be fed with the hot air drying system of the present invention to accomplish the accelerated drying of the cement in the joints of the veneer brick wall as it is being laid. This embodiment is depicted in FIG. 6, where veneer brick wall 51 is being laid adjacent building wall 53. A small gap between these walls 55 forms a vertical cavity into which the forced hot air system of the present invention can be ducted to accelerate the drying time of the cement in the joints in either or both walls 51 and 53.

It should be understood that the above description discloses specific embodiments of the present invention and are for purposes of illustration only. There may be other modifications and changes obvious to those of ordinary skill in the art that fall within the scope of the present invention which should be limited only by the following claims and their legal equivalents.

What is claimed is:

1. A heating system for a cemented hollow block wall, comprising:

a heat source;

a manifold in fluid communication with said heat source;

a plurality of injector tubes, each tube having first and second ends, said first end of each tube being in fluid communication with said manifold;

a plurality of hollow blocks laid together with cemented joints, block upon block, to form a building wall having at least one substantially vertical side surface; and a plurality of apertures in the side surface of said hollow block wall, said apertures receiving at least one of said second ends of said injector tubes whereby an internal cavity within said wall is in fluid communication with said heat source.

2. The heating system of claim 1, wherein said manifold is an elongate duct located parallel to and along the base of said side of said wall.

3. The heating system of claim 1, wherein said heat source provides hot air which is forced into said manifold.

4. The heating system of claim 3, wherein said heat source is fuel-burning.

5. The heating system of claim 1, wherein said injector tubes are flexible.

6. The heating system of claim 5, wherein said injector tubes comprise flexible aluminum tubing.

7. The heating system of claim 6, further including an adapter flange located between at least one of said first ends of said injector tubes and said manifold.

8. The method of heating a hollow block wall to accelerate the curing rate of drying cement in the joints of said wall, comprising the steps of:

laying a plurality of hollow blocks together with cemented joints, block upon block, to form a building wall having at least one substantially vertical side surface;

forming a plurality of temporary apertures in said side surface along the base of said wall;

providing a heat source; and injecting hot air from said heat source into said apertures in the side surface of said hollow block wall, whereby said hot air travels upward through an internal cavity in said wall, thus applying heat to blocks and joint cement located above the level at which said hot air is applied.

9. A heating system for a hollow cement structural element of a building, comprising:

a structural building element formed at least partially of wet cement to be dried;

a heat source;

ducting in fluid communication between said heat source and a hollow core within said building element, whereby heat is applied to the hollow core of said building element to accelerate the drying time of said wet cement.

10. The heating system of claim 9, wherein said hollow core is a void between parallel, spaced apart walls in close proximity.

* * * * *